US008387546B2

(12) United States Patent
David

(10) Patent No.: US 8,387,546 B2
(45) Date of Patent: Mar. 5, 2013

(54) FENCE TO CAPTURE WINDBLOWN PARTICLES

(75) Inventor: Erica Elizabeth David, Pinedale, WY (US)

(73) Assignee: Erica David, Pinedale, WY (US)

( * ) Notice: Subject to any disclaimer, the term of this patent is extended or adjusted under 35 U.S.C. 154(b) by 216 days.

(21) Appl. No.: 12/583,596

(22) Filed: Aug. 20, 2009

(65) Prior Publication Data

US 2011/0042636 A1 Feb. 24, 2011

(51) Int. Cl.
*A01C 15/00* (2006.01)
*E01F 7/02* (2006.01)

(52) U.S. Cl. ..... 111/200; 111/900; 256/12.5; 256/1

(58) Field of Classification Search ..... 111/200, 111/900; 256/12.5, 13, 19, 1
See application file for complete search history.

(56) References Cited

U.S. PATENT DOCUMENTS 1,541,241 A * 6/1925 Baxter ..... 256/12.5
3,672,638 A * 6/1972 Krebs ..... 256/12.5
4,339,114 A * 7/1982 Deike ..... 256/12.5
4,932,634 A * 6/1990 Sura ..... 256/12.5
6,043,195 A * 3/2000 Hutchinson et al. ..... 504/130
6,786,173 B2 * 9/2004 Courtemanche ..... 116/63 P
7,097,385 B2 * 8/2006 Tabler ..... 405/29
7,780,148 B2 * 8/2010 Kirby ..... 256/12.5

OTHER PUBLICATIONS

Derwent-Acc-No. 2008-M50545, Samho C&T Pty Ltd., "Wall surface afforestation fence for planting lianas and for fixing to wall of building, has fixing members that fix mesh panels together with predetermined space formed between mesh panels", May 29, 2008, Derwent Information Ltd., Derwent-Week: 200874, title page, abstract page and drawing page.*

* cited by examiner

*Primary Examiner* — Christopher J. Novosad

(57) ABSTRACT

The invention provides fences for capture and control of windblown particles such as snow. In preferred embodiments the fences comprise a porous upwind panel and a porous downwind panel which are separated by a gap. The fences are adapted to deposit windblown particles in highly concentrated drifts disposed upwind and/or downwind of the fence with relatively few particles deposited in the gap. Methods for snow capture and land reclamation are also provided.

12 Claims, 3 Drawing Sheets

Figure 1
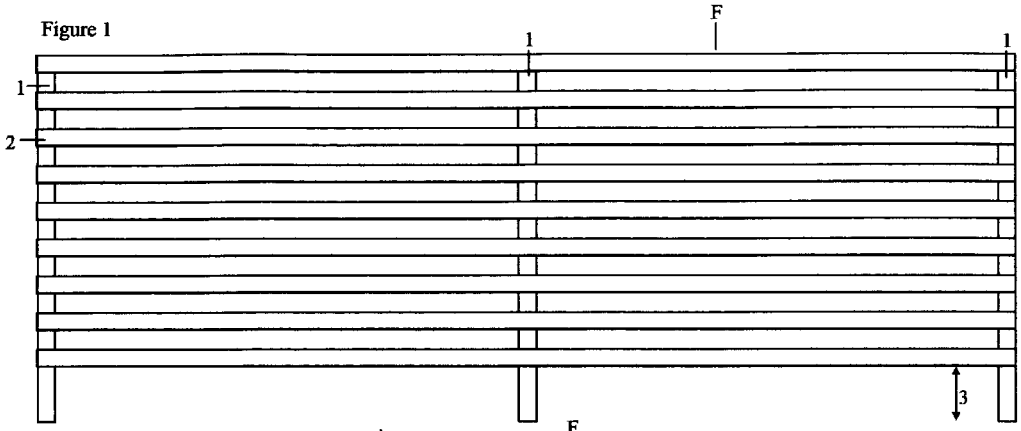
Figure 2
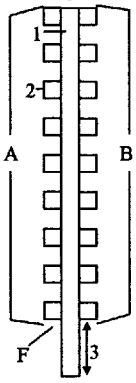
Figure 3
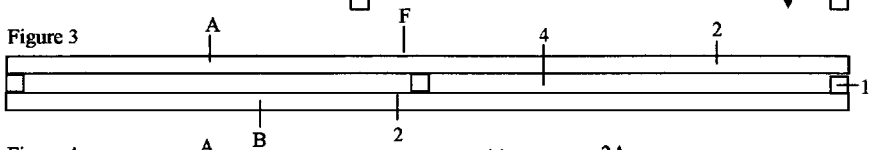
Figure 4
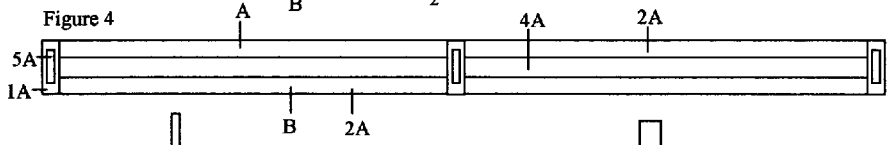
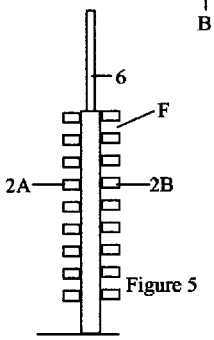
Figure 5
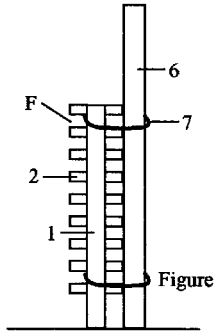
Figure 6
Figure 7
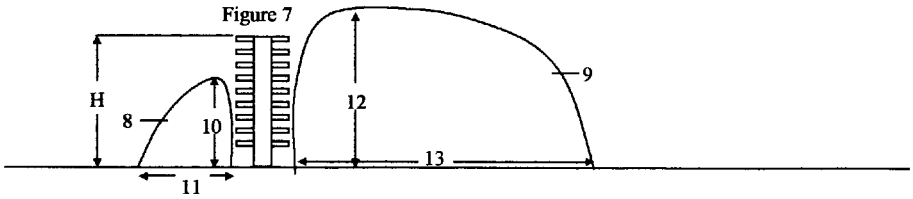
Figure 8 (Prior Art)
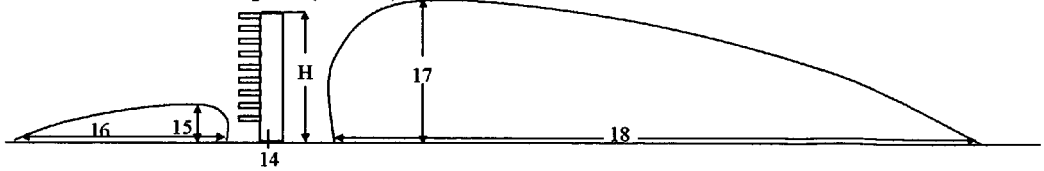

FENCE TO CAPTURE WINDBLOWN PARTICLES

BACKGROUND OF THE INVENTION

In areas exposed to wind and snow, in order to reduce drifting in undesired areas, snow fences are often used to capture windblown snow. An example of a common snow fence design is the Wyoming Design Board Snow Fence which consists of two or more vertical posts and a number of horizontal slats fixed along one side of the posts. The slats are spaced apart to allow wind to pass through but sufficiently close together to interrupt wind flow, create turbulence, and impose drag on the snow particles, thereby releasing snow from the wind and depositing it in drifts either upwind or downwind of the fence.

While current snow fences are effective in reducing undesired drifting, they suffer from certain drawbacks. First, current fence designs have not been optimized for maximum snow removal, and substantial quantities of snow are able to pass through these fences and remain windborne. In addition current fences are imprecise in the deposition of captured snow and tend to create drifts which are spread out over wide areas rather than dense drifts in close proximity to the fences.

Of further interest in connection with present invention is land reclamation. In land areas that have undergone mining, oil or gas drilling, or other activities resulting in devegetation, reclamation depends upon adequate irrigation. This is particularly important during the late spring and early summer when seeds are germinating. In areas of winter snow fall, melting snow can provide a water supply for such germinating seeds. However, in many areas, particularly where climate changes have resulted in higher temperatures and/or reduced snow fall, snow does not remain on the ground long enough to provide adequate irrigation during the period of seed germination. Therefore other irrigation sources are required such as wells, pumps, piping, and/or water trucks, dramatically increasing the cost and environmental impact of reclamation.

Because many areas undergoing reclamation have little vegetation and therefore few obstacles to wind, snow fences may be used to control drifting during the winter months. While the drifts created by such fences may have greater depth than the naturally dispersed snow cover, as pointed out above these drifts tend to be spread out over relatively large areas with fairly shallow depth. As a result these drifts melt more quickly than would a deep, concentrated drift, and frequently melt too early to provide adequate irrigation for seed germination. Therefore the use of other irrigation sources remains critical to successful reclamation even where snow fences are in use.

For these and other reasons, it would be desirable to provide a snow fence which maximized capture of windblown snow and optimized the characteristics of the drifts in which such snow is deposited. Desirably, the snow fence should deposit the snow in highly concentrated drifts of maximum depth in close proximity to the fence. Additionally, the snow fence should be low cost and simple to manufacture and install.

Further, it would be desirable to provide improved methods of land reclamation. Specifically, reclamation methods are needed which can extend the presence of winter snows to provide adequate irrigation for germinating seeds in the spring and thereby reduce the dependence upon external irrigation sources.

SUMMARY OF THE INVENTION

The invention provides a fence for capturing windblown particles such as snow, dust, sand, and the like. The fence maximizes the capture of windblown particles and deposits them in highly concentrated drifts of significantly greater depth than current fences. The invention further provides methods of capturing windblown particles and methods of land reclamation with substantial improvements over current methods.

According to the invention, a fence for capturing windblown particles carried by a wind blowing in a wind direction from an upwind direction to a downwind direction comprises a generally vertical upwind panel having a first porosity and first thickness; a generally vertical downwind panel having a second porosity and second thickness; wherein the downwind panel is generally parallel to the upwind panel and separated therefrom by a gap, and wherein the first thickness, the second thickness and the gap are selected to deposit the windblown particles upwind of the upwind panel and downwind of the downwind panel, with comparatively little deposition of particles between the upwind and the downwind panels. In exemplary embodiments, the gap is about 0.5-2 times the first thickness.

Preferably, the upwind panel has a first porosity of about 40-60% and the downwind panel has a second porosity of about 40-60%. In exemplary embodiments, the upwind panel comprises an upwind set of slats generally parallel and spaced apart from each other by a first distance, and the downwind panel comprises a downwind set of slats generally parallel and spaced apart from each other by a second distance. In one preferred embodiment, the downwind set of slats is separated from the upwind set of slats by a third distance, the third distance being about 0.5-3 times, preferably about 2 times, the first distance. In another embodiment, the upwind set of slats have a first thickness parallel to the wind direction and the downwind set of slats are separated from the upwind set of slats by a third distance, the third distance being about 0.5-2 times, and preferably about 1.0 times the first thickness. In other exemplary embodiments, the upwind and downwind slats may be generally horizontal, and each upwind slat has a first height in a generally vertical direction, and the first height is at least about equal to the first distance. Each downwind slat may have a second height in a generally vertical direction, wherein the second height is at least about equal to the second distance.

In a particular embodiment, the snow fence comprises at least one upright, the upwind panel is fixed to an upwind side of the upright, and the downwind panel is fixed to a downwind side of the upright. The upright may be adapted for mounting in the ground or for coupling to a post.

In other embodiments, the upwind panel and downwind panel are formed of a molded material. For example, the upwind panel and downwind panel may be formed of an injection molded plastic. In addition the upwind panel, downwind panel, and uprights may be all part of a unitary molded structure. Additionally, the uprights may have a hollow interior adapted to receive a post.

Preferably, the fence is adapted to deposit the windblown particles in drifts upwind and/or downwind of the fence with relatively few particles deposited between the upwind and downwind panels. In an exemplary embodiment, no more than about 1% of the particles are deposited between the upwind panel and the downwind panel. If the fence is used for snow, the first thickness, the second thickness, and the gap are selected to deposit the snow in a downwind drift having a length parallel to the wind direction and a depth in a vertical direction, wherein at equilibrium the length is no more than about 20 times the height of the fence. In a particularly preferred embodiment, the depth of the downwind drift at equilibrium is at least about 1.0 and more preferably about 1.2 times the height of the fence. "Equilibrium" means the condition in which the fence has been exposed to sufficient snowfall and wind so as to have captured the maximum quantity of snow of which it is capable and no significant additional snow will be captured by the fence. Hence, the drift created by the fence will be of maximum size at equilibrium.

The invention further provides a method of capturing windblown snow carried by a wind blowing in a wind direction, comprising providing a snow fence configured to deposit a drift of snow downwind of the snow fence, the drift having a length in the wind direction and a depth in a vertical direction, the length being no more than about 20 times the height of the snow fence. In preferred embodiments, the snow fence has a generally vertical upwind panel and a generally vertical downwind panel, the upwind panel and the downwind panel being generally parallel to each other and separated by a gap. In a preferred embodiment, the snow fence comprises at least one upright, a generally vertical porous upwind panel fixed to an upwind side of the upright, and a generally vertical porous downwind panel fixed to a downwind side of the upright.

The invention also provides a method of reclamation of a land area exposed to windblown snow in winter, the land area containing seeds which germinate on or after a germination date. The method may comprise positioning one or more snow fences in the land area during at least a portion of the winter, each snow fence depositing a drift of snow downwind of the snow fence, each drift being deposited in a configuration adapted to remain at least partially unmelted until the germination date, wherein the seeds are irrigated by melting the drift after the germination date. In an exemplary embodiment, the germination date is during the months of May or June.

Preferably, each snow fence deposits a drift which melts over substantially longer periods than current snow fences. In preferred embodiments the drifts produced according to the present invention will be of significantly higher density than the natural snow pack, e.g. average drift density at equilibrium will be at least about 25 g/100 $cm^3$ and more preferably at least about 30 g/100 $cm^3$, with natural snowpack density being less than 20 g/100 $cm^3$ under the same local conditions. The reclamation methods of the invention have been shown to extend snow presence an average of 40-60 days longer than the natural snow pack in arid high desert climates. Rates of soil moisture changes during the spring thaw have been measured and the present invention has been shown to increase soil moisture at a rate over 2.5 times that produced by natural snow pack in the same areas. And this rate of moisturization is maintained for much longer periods than under natural conditions such that soil moisture is sufficient for seed germination in May and June. This has resulted in a 30-70% increase in seed germination in such areas.

Where there is a prevailing wind over the land area that blows in a wind direction, each snow fence deposits a drift having a length in the wind direction and a depth in a vertical direction, wherein at equilibrium, the length is no more than about 20 times the height of the snow fence. In one embodiment each snow fence deposits a drift which at equilibrium has a depth at least about 1.0 and more preferably at least about 1.2 times the height of the snow fence.

In preferred embodiments of the reclamation method, a plurality of snow fences are positioned in the land area in positions selected such that the drift deposited by each snow fence overlaps at least one other drift deposited by another of the snow fences. Preferably, the drifts deposited by all of the snow fences collectively cover substantially all of the land area, or are positioned in close enough proximity to one another to provide a water to substantially all of the land area as the drifts melt.

The reclamation method preferably utilizes a snow fence having a generally vertical upwind panel and a generally vertical downwind panel, the upwind panel and the downwind panel being generally parallel to each other and separated by a gap. The upwind panel has a first thickness parallel to the wind direction and the gap is about 0.5-2 times the first thickness. The generally vertical upwind panel may have a first porosity of about 40-60% and the generally vertical downwind panel may have a second porosity of about 40-60%, both porosities being about 50% in preferred embodiments. In one embodiment, the snow fence comprises at least one upright, a generally vertical porous upwind panel fixed to an upwind side of the upright, and a generally vertical porous downwind panel fixed to a downwind side of the upright.

In exemplary embodiments the upwind panel comprises an upwind set of slats generally parallel and spaced apart from each other by a first distance, and the downwind panel comprises a downwind set of slats generally parallel and spaced apart from each other by a second distance. Preferably the downwind set of slats is separated from the upwind set of slats by a third distance, the third distance being about 0.5-3 times the first distance. The upwind set of slats may have a first thickness parallel to the wind direction and the downwind set of slats are separated from the upwind set of slats by a third distance, the third distance being about 0.5-2 times the first thickness.

Further aspects of the fence and methods of the invention will become apparent from the following detailed description taken in conjunction with the drawings.

BRIEF DESCRIPTION OF THE DRAWINGS

FIG. 1 is a side view of a snow fence according the present invention.

FIG. 2 is an end view of the snow fence of FIG. 1.

FIG. 3 is a top view of the snow fence of FIG. 1.

FIG. 4 is a top view of an alternative embodiment of a snow fence according to the invention.

FIG. 5 is an end view of the snow fence of FIG. 1 supported by a post inserted through the fence.

FIG. 6 is an end view of the snow fence of FIG. 1 coupled to a post positioned outside of the fence.

FIG. 7 is an end view of a snow fence according to the invention showing the snow drifts created thereby.

FIG. 8 is an end view of a snow fence according to the prior art showing the snow drifts created thereby.

DETAILED DESCRIPTION OF SPECIFIC EMBODIMENTS

Figure 9:
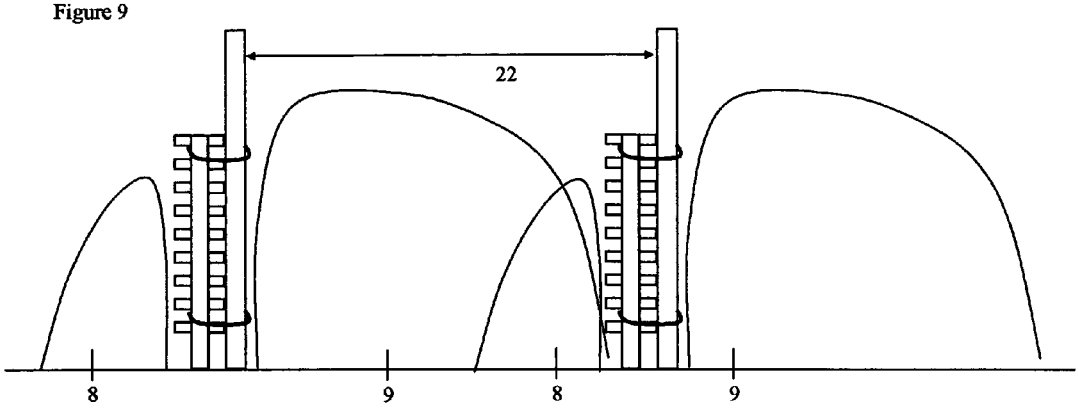
FIG. 9 is an end view of two snow fences and the drifts created therewith in accordance with the methods of the invention.

A fence according the invention for capturing windblown particles, especially snow, is referred to herein as the "Hollow Frame Fence." The Hollow Frame Fence utilizes novel design concepts to generate groundbreaking snow capture, water conservation, and vegetation germination results. In preferred embodiments, the design follows a two panel layout, which generates the turbulence and decreased velocity necessary to maximize snow deposition in the high volume, small footprint drift essential for accurate water placement.

In the exemplary embodiment seen in FIG. 1, fence F comprises three uprights, labeled 1, arranged, parallel, with two on panel ends and one at the midpoint. As shown in FIGS. 2 and 3, an upwind panel A is attached to an upwind side of uprights 1, and a downwind panel B is attached to a downwind side of uprights 1. Upwind panel A comprises a let of slats, labeled 2, which run perpendicular and begin flush with one end of the uprights 1. Slats 2 are preferably attached with equal spacing, so that 50% porosity is achieved, although various spacings and porosities are possible. Downwind panel B similarly comprises a set of slats 2 attached to the downwind side of the uprights, following the same methodology as the first panel. Slats 2 may be attached with screws, nails, staples, or by any other suitable fastening means. A bottom clearance space, labeled 3 as seen in FIGS. 1 and 2, can range between 0 and 15% of the total fence height. Total fence height may be in the range of 0.25 meters to four meters or more, and total fence length (between the uprights 1 at the ends of panels A, B) may be from 1 meter to as long as 100 meters or more depending upon the application. Upwind panel A and downwind panel B (including slats 2) may be constructed of a variety of materials, including but not limited to wood, metal, or plastic.

FIG. 3 shows a top view of the snow fence of FIG. 1. A gap 4 between the upwind panel A and downwind panel B enhances the generation of turbulence and drag resulting in the desired drift deposition. The width of gap 4 is preferably about 1.5-2 times the thickness of slats 2, the thickness being the dimension of slats 2 in the horizontal direction of wind flow between the slats, that is, perpendicular to the vertical surface of the panel. Slats 2 may have a variety of thicknesses depending upon the application and the fence height, but in a preferred embodiment for fences up to 1 meter in height, slats 2 are between 0.5 and 4 inches in thickness. Alternatively, gap 4 is about 0.5-3 times the vertical spacing between slats 2. The vertical spacing between slats 2 will depend upon various factors but generally will be equal to the vertical width of slats 2 so as to result in 50% porosity in upwind panel A and downwind panel B. In preferred embodiments the vertical spacing is about 1.75-2 inches. In specific embodiments gap 4 is defined by the thickness of uprights 1 to which slats 2 are directly attached as shown in FIG. 3.

Upwind panel A and downwind panel B are attached in the vertical, upright position to posts, such as steel T-posts, labeled 6, through wiring or other means, labeled 7, as seen in FIG. 6. Alternatively, T-posts 6 may be inserted through gap 4 to maintain the fence in the vertical position. In another embodiment, uprights 1 may be adapted on their lower ends for mounting directly into the ground or for fastening to a mounting base.

FIG. 4 shows an alternate embodiment in which upwind panel A, downwind panel B and uprights 1 all are formed in a unitary molded structure of plastic or other moldable material. Preferably in this embodiment the fence is a single-piece injection molded part. In this embodiment, the fence may include the additional aspect of hollow uprights, labeled 1A with hollow interior spaces labeled 5A, allowing for the placement of posts, labeled 6A, within the upright 1A, eliminating need for attachments such as wire and decreasing installation time, as seen in FIG. 5.

When analyzing the benefits and significant differences of the Hollow Frame Fence as compared to traditional fencing, the resultant snow drift profile becomes extremely important. FIGS. 7 and 8 compare the snow drift profiles of the Hollow Frame Fence and the traditional Wyoming Design Board Snow Fence respectively, highlighting dimensional aspects as confirmed by prior research. Referring to FIG. 7, the Hollow Frame Fence generates both an upwind drift, labeled 8, and a downwind drift, labeled 9. In a preferred embodiment, at equilibrium, or full potential, the upwind drift 8 has a depth 10 at least about 0.7, usually at least about 0.8 times, the total fence height, and a length 11 no more than about 8 times, preferably no more than about 7 times the height of the fence. The downwind drift 9 has a depth 12 of at least 1.0 times and preferably at least about 1.2 times the height of the fence, and a length 13 no more than about 20 times, preferably no more than about 18 times the height of the fence. This is in sharp comparison to the traditional Wyoming Design Board Snow Fence, as seen in FIG. 8, whose dimensions are as follows. The upwind drift measures: 0.6H deep, labeled 15, and 15H long, labeled 16. The downwind drift measures: 1.2H deep, labeled 17, and 35H long, labeled 18. The significantly decreased footprint size produced by the fence of the invention is complimented by a substantial increase in total drift volume, based on extended depth throughout the length of the drift, and increased snowpack density, resulting in more snow packed at high density into a smaller, more manageable area.

Reclamation Process

Figure 10:
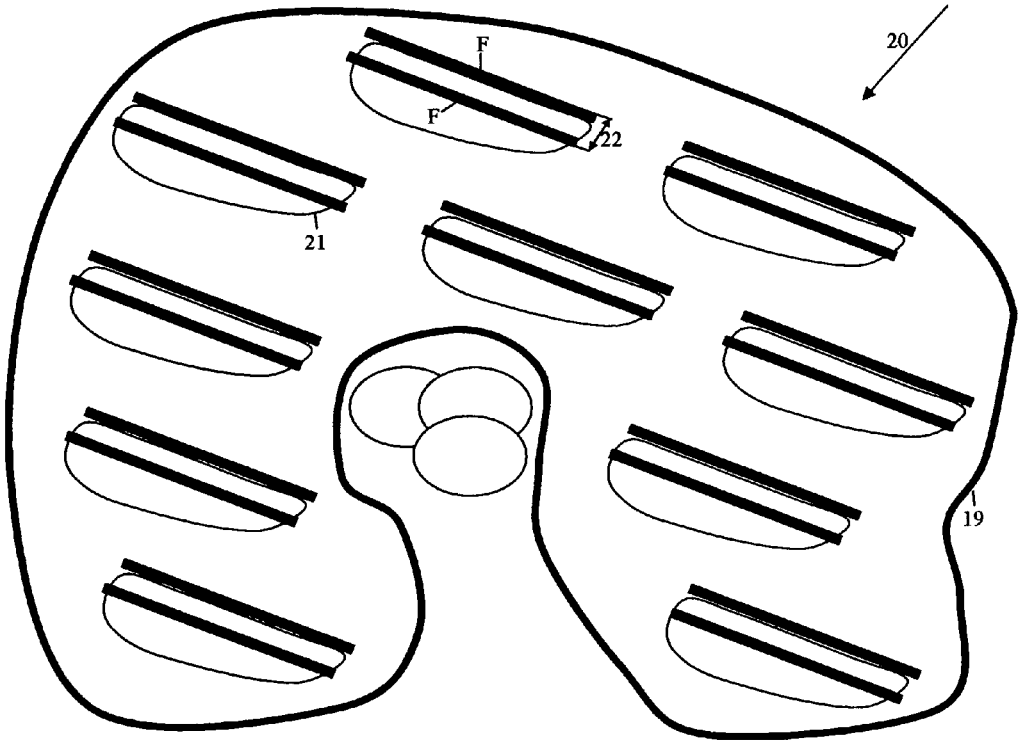
FIG. 10 is a top elevational view of a plurality of snow fences used in accordance with the reclamation methods of the invention.
Figure 11:
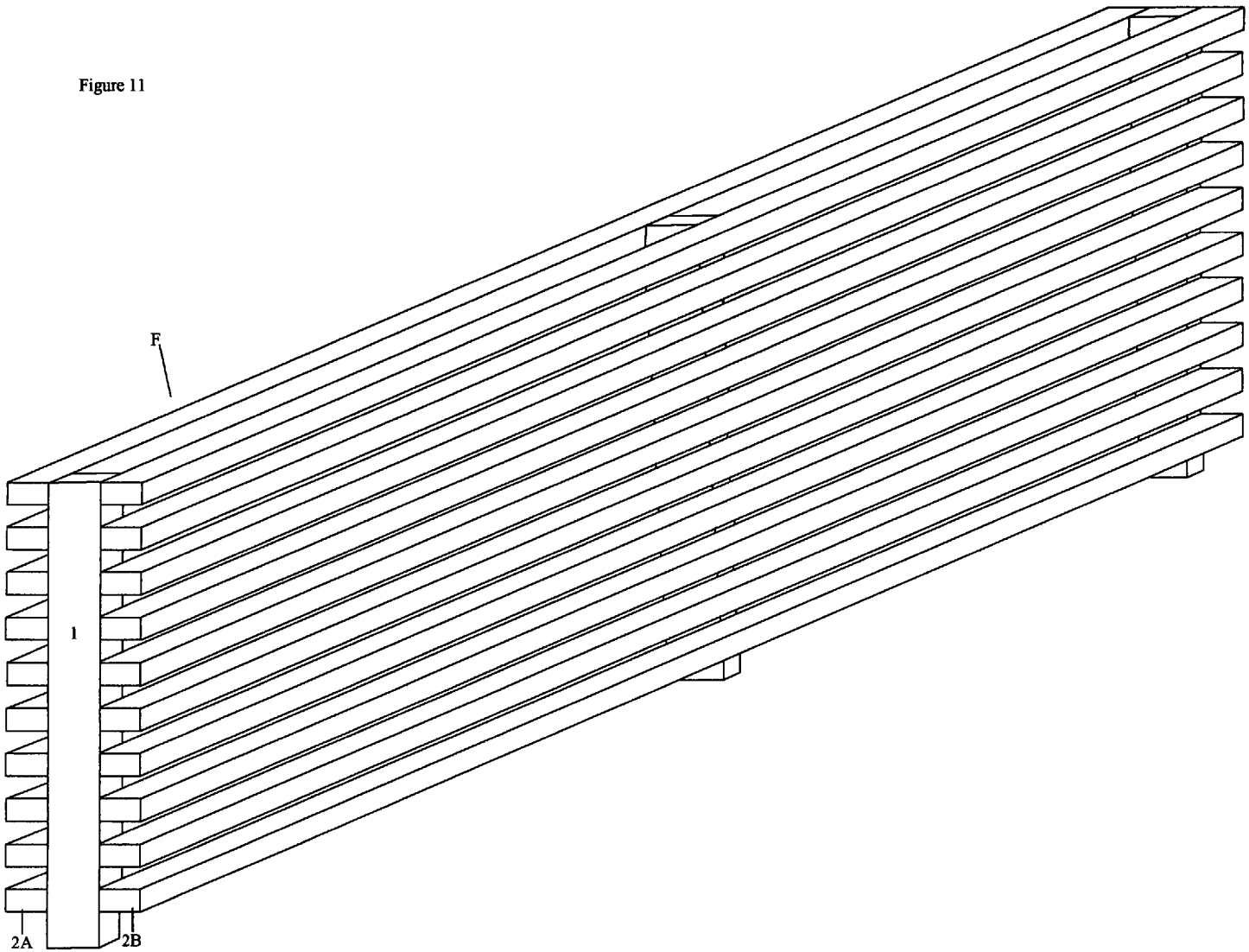
FIG. 11 is an oblique view of the snow fence of FIG. 1.

Reclamation occurring in arid high desert climates is perhaps most difficult, due to lack of necessary water supplies during key germinating periods. To remedy this, the capture and retention of snow as a natural water source for use where traditional watering tactics continually fall short of success. The use of snow fencing on reclamation sites, labeled 19 in FIG. 10, lays the foundation for a revolutionary new reclamation increasing rollover rates and long term success of reclaimed areas. Fence panels, either the Hollow Frame Fence described above or another conventional fence, are placed on the reclamation area perpendicular to prevailing winds, labeled 20 in FIG. 10, with consideration given to local climate and topography, as seen in FIGS. 9 and 10. Preferably, fence lines should be placed in parallel pairs, each pair spaced apart a distance 22 of about 6-15 times, more preferably 11-13 times, and most preferably about 12 times the fence height H (For example, for fences 0.5 meter tall, fence lines should be placed about 6 meters apart). This maximizes the drifting potential of the fences as a set, however, greater or lesser spacing can be implemented. The ideal distance 22 between fences will depend upon various factors including the height and type of fences used. Conventional fences producing drifts of larger area may be placed further apart (although greater overlap of drifts may be required for fences producing drifts of lower density). FIG. 9 shows a top elevational view of a set of fences, arranged to maximize snow capture by overlapping the resultant drifts, labeled 8 and 9. Fences are aligned to accumulate snow directly above where water is needed during germination, often in a mosaic pattern, as seen in FIG. 10. As seen in the figure, each set of fences, labeled 21, results in drifting that can substantially cover the site. The amount of drift overlap will be selected so as to provide continuous moisturization of the underlying soil for sufficient time to allow seeds to germinate.

During spring, drifts retain snow as a water supply above ground longer, allowing it to release moisture during key germination periods rather than prematurely. In a preferred embodiment, the fences are configured to provide drifts with sufficient density and depth so as to melt over an extended period of time during the spring, at least through the germination period for certain seeds. For example in certain arid high desert climates, while natural snow melt begins in February, the method will produce drifts which survive through seed germination in May. Preferably, the fences are configured to deposit drifts which at equilibrium have a depth at least about 1.2 times the fence height and a length no more than about 20 times the fence height. The drifts will usually have an average density substantially higher than the natural snow pack in the same area that would occur in the absence of the fences, preferably at least about 1.5 times the average density of the natural snow pack. Additionally, the use of fencing according to the invention offers increased wind protection, preventing soil erosion, sublimation of present soil moisture, as well as protection for young seedlings. Fences would remain onsite until substantial vegetation growth had occurred, and then could be rotated to upcoming reclamation sites.

Although the above embodiments have been described in the context of windblown snow control, it should be understood that the principles of the invention may be applied to various other wind and waterborne particles, including dust, sand, soil, and other materials. The invention may further be used for various purposes including erosion control, riverbank and beach retention, and others.

While the above is a complete description of the preferred embodiments of the invention, various alternatives, substitutions, additions, and modifications are possible without departing from the scope hereof, which is defined by the following claims.

What is claimed is:

1. A method of reclamation of a land area exposed to windblown snow in winter, the land area containing seeds which germinate on or after a germination date, the method comprising: positioning one or more snow fences in the land area during at least a portion of the winter, each snow fence depositing a drift of snow downwind of the snow fence, each drift being deposited in a configuration adapted to remain at least partially unmelted until the germination date; wherein the seeds are irrigated by melting the drift after the germination date.

2. The method of claim 1 wherein the drift has an average density of at least about 25 g/100 cm.sup.3.

3. The method of claim 1 wherein a prevailing wind over the land area blows in a wind direction, and wherein each snow fence has a fence height and deposits a drift having a length in the wind direction, at equilibrium the length, being no more than about 20 times the fence height.

4. The method of claim 1 wherein a plurality of snow fences are positioned in the land area in positions selected such that the drift deposited by each snow fence overlaps at least one other drift deposited by another of the snow fences.

5. The method of claim 4 wherein the drifts deposited by all of the snow fences collectively cover substantially all of the land area.

6. The method of claim 1 wherein the snow fence has a generally vertical upwind panel and a generally vertical downwind panel, the upwind panel and the downwind panel being generally parallel to each other and separated by a gap.

7. The method of claim 6 wherein the generally vertical upwind panel has a first porosity of about 40-60% and the generally vertical downwind panel has a second porosity of about 40-60%.

8. The method of claim 7 wherein the upwind panel comprises an upwind set of slats generally parallel and spaced apart from each other by a first distance.

9. The method of claim 7 wherein the downwind panel comprises a downwind set of slats generally parallel and spaced apart from each other by a second distance.

10. The method of claim 9 wherein the downwind set of slats are separated from the upwind set of slats by a third distance, the third distance being about 0.5-3.0 times the first distance.

11. The method of claim 1 wherein the snow fence comprises at least one upright, a generally vertical porous upwind panel fixed to an upwind side of the at least one upright, and a generally vertical porous downwind panel fixed to a downwind side of the at least one upright.

12. The method of claim 1 wherein natural snow pack is disposed adjacent to the drifts, the natural snow pack having an average natural density and the drifts having an average drift density, the average drift density being at least about 1.5 times the average natural density.

* * * * *